US006874957B2

(12) United States Patent
Fujita

(10) Patent No.: US 6,874,957 B2
(45) Date of Patent: Apr. 5, 2005

(54) PRINTING APPARATUS, INFORMATION PROCESSING APPARATUS, CONTROL METHOD THEREFOR AND PROGRAM

(75) Inventor: Yoshifumi Fujita, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/651,736

(22) Filed: Aug. 29, 2003

(65) Prior Publication Data

US 2004/0052564 A1 Mar. 18, 2004

(30) Foreign Application Priority Data

Aug. 30, 2002 (JP) ..... 2002-254986

(51) Int. Cl.[7] ..... B41J 5/30

(52) U.S. Cl. ..... 400/62; 400/76; 358/1.2; 382/282

(58) Field of Search ..... 101/35, 41, 484, 101/485; 400/61, 62, 76; 358/1.2, 1.12; 382/282, 286, 298

(56) References Cited

U.S. PATENT DOCUMENTS 5,040,078 A * 8/1991 Yahara ..... 358/448
5,708,513 A * 1/1998 Hasuo et al. ..... 358/450
5,967,676 A * 10/1999 Cutler et al. ..... 400/70
5,970,183 A * 10/1999 Amemiya et al. ..... 382/282

* cited by examiner

*Primary Examiner*—Ren Yan
(74) *Attorney, Agent, or Firm*—Morgan & Finnegan LLP

(57) ABSTRACT

Print control information containing information on a print reference position, print area designation region, and print medium, and image data corresponding to the print area designation region are received via an I/F. An MPU determines the print reference position concerning printing of the image data on the basis of the print control information. The rejection amount of image data which is not used for printing but is rejected out of the image data is calculated on the basis of the determination result, the print area designation region, and the printable region of the print medium. Image data corresponding to the calculated rejection amount is rejected from the image data. Printing of the image data is controlled using image data which is not rejected.

7 Claims, 10 Drawing Sheets

PRINTING APPARATUS, INFORMATION PROCESSING APPARATUS, CONTROL METHOD THEREFOR AND PROGRAM

FIELD OF THE INVENTION

The present invention relates to a printing apparatus which conveys a tray supporting a print medium into the printing apparatus and prints on the print medium by using the top or bottom of the tray as a print reference position, an information processing apparatus which generates image data to be printed by the printing apparatus, a control method therefor, and a program.

BACKGROUND OF THE INVENTION

Some conventional image printing apparatuses have a printing function capable of printing an image on the surface of a disc such as a CD-R. In general, an image printing apparatus having such printing function can realize printing on a disc by setting a disc to be printed on a dedicated disc tray and locating the disc at a print position within the apparatus.

Print data for printing an image on a disc is generated by, e.g., a host apparatus connected to the image printing apparatus. Even when a print area designation region (logical print area) 210 set by a printer driver installed in the host apparatus which performs print control for the image printing apparatus is the same as the physical print area of a disc tray 200, as shown in FIG. 8, not all image data corresponding to the print area designation region are printed in the entire physical print area of the disc tray 200, but only image data of a portion (printable region 201) corresponding to a disc to be printed is used for actual printing.

Part of image data generated by the host apparatus is rejected (not used for printing but discarded) on the basis of the positional relationship between the physical print area of the disc tray 200 and the print area designation region set by the printer driver.

In the example of FIG. 8, as for the rejection amount of image data which is unnecessary for printing and rejected, image data of characters E to M are actually printable image data, and image data of the remaining characters A to D and N are rejected out of image data of characters A to N generated by the printer driver, regardless of whether the reference is the top or bottom of the disc tray.

In a conventional image printing apparatus, the print area designation region (220 or 230) set by the printer driver may be longer than the physical print area of the disc tray 200, as shown in FIGS. 9 and 10. In the example of FIG. 9, when the top of the disc tray is set as a reference for calculating the rejection amount of image data, image data to be printed are image data of characters E to M, and image data of the remaining characters A to D and N to W are rejected. The print result is the same as that in FIG. 8.

To the contrary, in the example of FIG. 10, when the bottom of the disc tray is set as a reference for calculating the rejection amount of image data, image data to be printed are image data of characters N to V, and image data of characters A to M and W are rejected. The print result in FIG. 10 is, therefore, different from that in FIG. 8.

When the rejection amount is calculated using the top of the disc tray as a reference, the disc tray length (DISC_TRAY_LENGTH) must be stored as a fixed value in the image printing apparatus, and cannot cope with a change in disc tray specification (shape, print area, or the like).

To the contrary, when the rejection amount is calculated using the bottom of the disc tray as a reference, the rejection amount is calculated on the basis of a disc tray length (disc_tray_length) supplied from the printer driver, and can cope with a change in disc tray specification on the printer driver side.

As described above, the disc tray top reference and disc tray bottom reference for calculation of the rejection amount have merits and demerits. A conventional image printing apparatus can only cope with either reference.

SUMMARY OF THE INVENTION

The present invention has been made to overcome the conventional drawbacks, and has as its object to provide a printing apparatus capable of appropriately executing print processes corresponding to various print conditions on a print medium set on a tray, an information processing apparatus, a control method therefor, and a program.

According to the present invention, the foregoing object is attained by providing a printing apparatus which conveys a tray supporting a print medium into the printing apparatus and prints on the print medium by using a top or bottom of the tray as a print reference position, comprising:

reception means for receiving print control information containing information on the print reference position, a print area designation region, and a print medium, and image data corresponding to the print area designation region;

determination means for determining the print reference position concerning printing of the image data on the basis of the print control information;

calculation means for calculating a rejection amount of image data which is not used for printing but is rejected out of the image data, on the basis of a determination result of the determination means, the print area designation region, and a printable region of the print medium;

rejection means for rejecting, from the image data, image data corresponding to the rejection amount calculated by the calculation means; and control means for controlling printing of the image data by using image data which is not rejected by the rejection means.

In a preferred embodiment, the information on the print reference position that is contained in the print control information includes information representing whether the print reference position is the top or bottom of the tray.

In a preferred embodiment, the calculation means calculates, as the rejection amount, a margin region between a top of the print area designation region and a top of the printable region of the print medium on the basis of the print reference position determined by the determination means.

In a preferred embodiment, the print medium includes a disc medium.

In a preferred embodiment, the reception means receives the print control information and the image data from a host apparatus connected to the printing apparatus.

According to the present invention, the foregoing object is attained by providing an information processing apparatus which generates image data to be printed by a printing apparatus that conveys a tray supporting a print medium into the printing apparatus and prints on the print medium by using a top or bottom of the tray as a print reference position, comprising:

generation means for generating print control information containing information on the print reference position, a print area designation region, and a print medium; and transmission means for transmitting the print control information, and image data corresponding to the print area designation region to the printing apparatus.

In a preferred embodiment, the generation means and the transmission means are implemented as functions of a dedicated application running on the information processing apparatus or a printer driver of the printing apparatus.

According to the present invention, the foregoing object is attained by providing a method of controlling a printing apparatus which conveys a tray supporting a print medium into the printing apparatus and prints on the print medium by using a top or bottom of the tray as a print reference position, comprising:

a reception step of receiving print control information containing information on the print reference position, a print area designation region, and a print medium, and image data corresponding to the print area designation region;

a determination step of determining the print reference position concerning printing of the image data on the basis of the print control information;

a calculation step of calculating a rejection amount of image data which is not used for printing but is rejected out of the image data, on the basis of a determination result of the determination step, the print area designation region, and a printable region of the print medium;

a rejection step of rejecting, from the image data, image data corresponding to the rejection amount calculated in the calculation step; and a control step of controlling printing of the image data by using image data which is not rejected in the rejection step.

According to the present invention, the foregoing object is attained by providing a method of controlling an information processing apparatus which generates image data to be printed by a printing apparatus that conveys a tray supporting a print medium into the printing apparatus and prints on the print medium by using a top or bottom of the tray as a print reference position, comprising:

a generation step of generating print control information containing information on the print reference position, a print area designation region, and a print medium; and a transmission step of transmitting the print control information, and image data corresponding to the print area designation region to the printing apparatus.

According to the present invention, the foregoing object is attained by providing a program which realizes control of a printing apparatus that conveys a tray supporting a print medium into the printing apparatus and prints on the print medium by using a top or bottom of the tray as a print reference position, comprising:

a program code for a reception step of receiving print control information containing information on the print reference position, a print area designation region, and a print medium, and image data corresponding to the print area designation region;

a program code for a determination step of determining the print reference position concerning printing of the image data on the basis of the print control information;

a program code for a calculation step of calculating a rejection amount of image data which is not used for printing but is rejected out of the image data, on the basis of a determination result of the determination step, the print area designation region, and a printable region of the print medium;

a program code for a rejection step of rejecting, from the image data, image data corresponding to the rejection amount calculated in the calculation step; and a program code for a control step of controlling printing of the image data by using image data which is not rejected in the rejection step.

According to the present invention, the foregoing object is attained by providing a program which realizes control of an information processing apparatus that generates image data to be printed by a printing apparatus that conveys a tray supporting a print medium into the printing apparatus and prints on the print medium by using a top or bottom of the tray as a print reference position, comprising:

a program code for a generation step of generating print control information containing information on the print reference position, a print area designation region, and a print medium; and a program code for a transmission step of transmitting the print control information, and image data corresponding to the print area designation region to the printing apparatus.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENT

A preferred embodiment of the present invention will be described in detail below with reference to the accompanying drawings.

Processing of "rejecting" part of data, which will be described in the following embodiment, is to process part of data so as not to use it for printing or to discard part of data.

Figure 1:
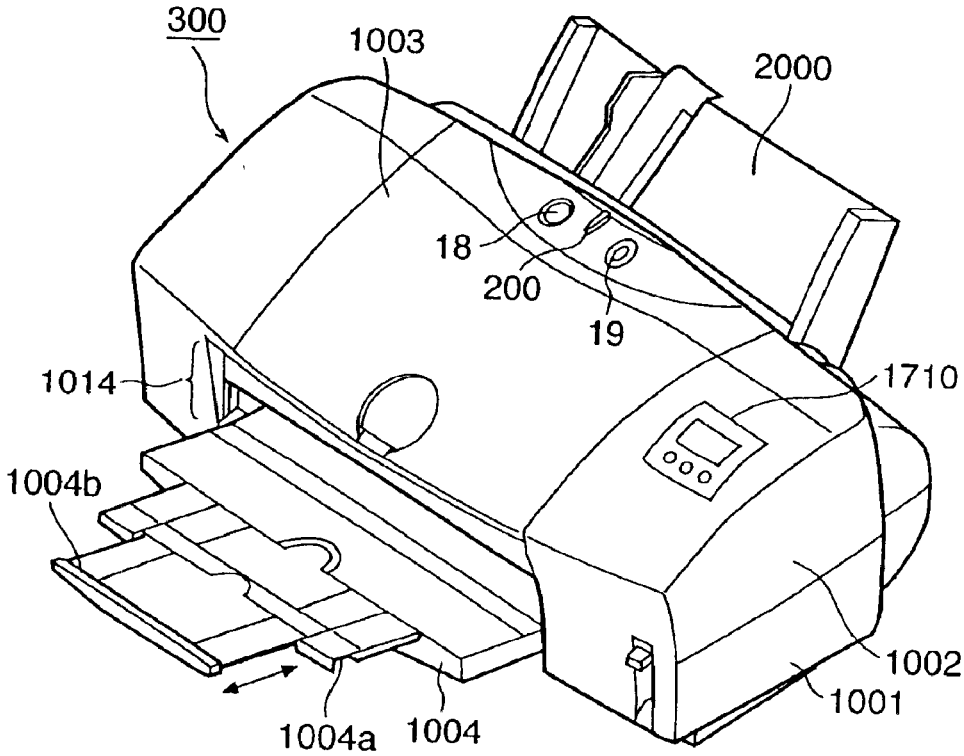
FIG. 1 is a perspective view showing the outer appearance of an image printing apparatus which can be applied to an embodiment of the present invention.

FIG. 1 is a perspective view showing the outer appearance of an image printing apparatus which can be applied to the embodiment of the present invention.

As the image printing apparatus of the embodiment, an ink-jet printing apparatus (to be simply referred to as a printing apparatus hereinafter) which prints by an ink-jet method will be exemplified. The printing method is not particularly limited as far as the printer can execute various processes of the embodiment to be described later.

In FIG. 1, an apparatus main body 1000 which forms a housing of the printing apparatus according to the embodiment has a lower case 1001, upper case 1002, access cover 1003, and exhaust tray 1004 as exterior members, and a chassis 17 (FIG. 2) stored in the exterior member 1004. The chassis 17 is constituted by a plurality of plate-like metal members having a predetermined rigidity, forms the frame of a printing apparatus 300, and holds print operation mechanisms to be described later.

The lower case 1001 nearly forms the lower half portion of the apparatus main body 1000, and the upper case 1002 nearly forms the upper half portion of the apparatus main body 1000. By combining these cases, a hollow structure which has a storage space that stores mechanisms to be described later is formed. Openings are respectively formed on the upper and front surfaces of the main body.

One end portion of the exhaust tray 1004 is rotatably held by the lower case 1001, and rotation of the tray 1004 opens/closes an opening 1014 formed on the front surface of the lower case 1001. For this reason, upon making the printer execute print operation, the exhaust tray 1004 is rotated toward the front surface side to open the opening 1014, so that print media can be exhausted from the opening 1014 and exhausted print media can be sequentially stacked.

The exhaust tray 1004 stores two auxiliary trays 1004*a* and 1004*b*. When these trays are pulled out as needed, the loading area of print sheets can be enlarged/reduced in three steps.

One end portion of the access cover 1003 is rotatably held by the upper case 1002 to be able to open/close the opening formed on the upper surface of the main body. When the access cover 1003 is opened, a printhead 1 or ink tank 7 housed in the main body can be exchanged at the exchange position.

Although not shown, when the access cover 1003 is opened/closed, a projection formed on the rear surface of the cover 1003 rotates a cover open/close lever. By detecting the rotation position of the lever using a microswitch or the like, the open/close state of the access cover can be detected.

The first embodiment provides a disc tray for mounting disc media having various thicknesses (e.g., CD-R/RW, DVD-R/RW, and cartridge storage medium (MO, DVD-RAM, or the like)) as print media and conveying the disc media to the printing apparatus 300 via its opening 1014, and a mounting mechanism on which a tray guide for guiding the disc tray into the printing apparatus 300 and supporting the disc tray can be mounted from the front surface.

A guide detection sensor 28 (FIG. 2) is arranged near the opening 1014, and can detect whether the tray guide is mounted.

A power key 18 and resume key 19 are arranged on the upper rear surface of the upper case 1002 so that the user can press it. Also, an LED 200 is arranged, and when the power key 18 is pressed, is turned on to notify the operator that the printing apparatus is ready to print.

The LED 200 has various display functions of changing the flickering pattern or color, and sounding a buzzer to notify the operator of a trouble of the printing apparatus 300 or the like.

If the trouble or the like is solved, the resume key 19 is pressed to restart printing.

A display 1710 displays various states of the printing apparatus 300.

Figure 2:
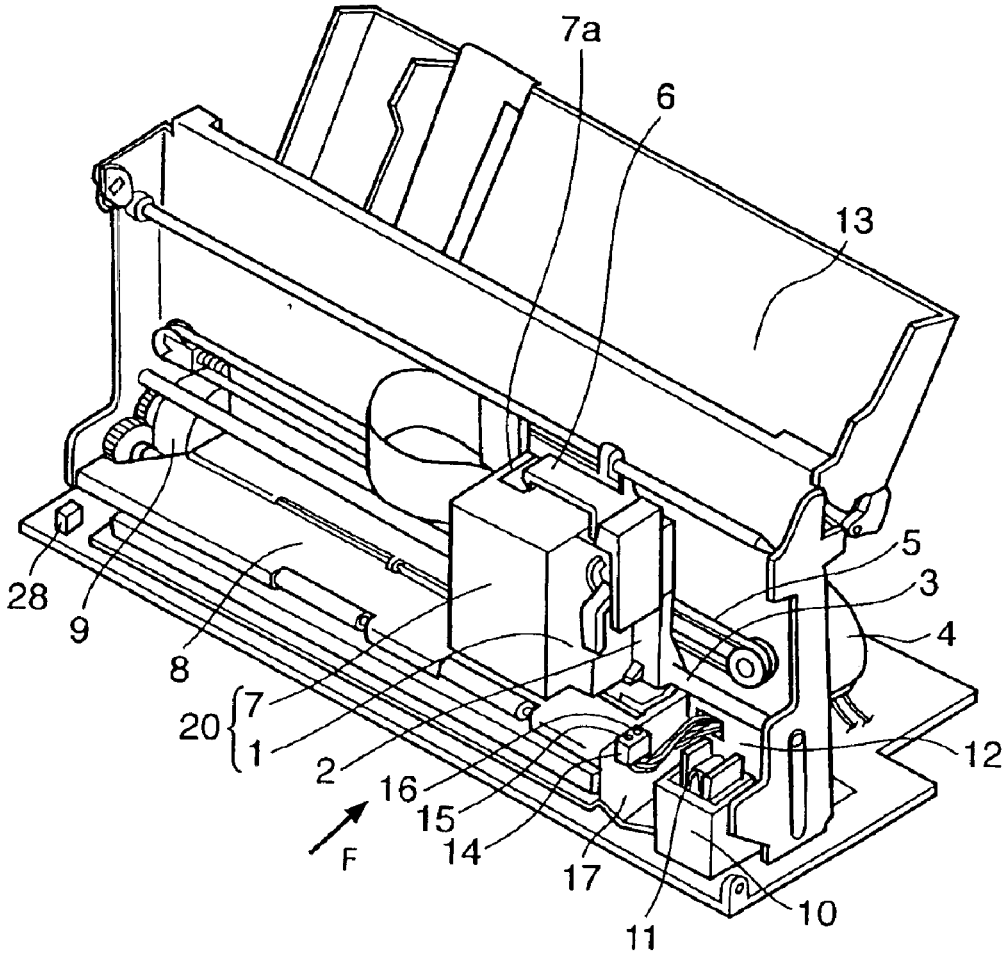
FIG. 2 is a perspective view showing a state in which the exterior members of the printing apparatus according to the embodiment of the present invention are removed.

FIG. 2 is a perspective view showing a state in which the exterior members of the printing apparatus according to the embodiment of the present invention are removed.

In the embodiment, as shown in FIG. 2, the printhead 1 is integrally coupled to the ink tank 7 for supplying ink to the printhead 1, thus constituting an ink cartridge 20.

In the embodiment, the ink cartridge 20 can be divided into the printhead 1 and ink tank 7. A cartridge as a unit of a printhead and ink tank may be used. The ink cartridge 20 contains four, Y (Yellow), M (Magenta), C (Cyan), and K (blacK) inks. With any arrangement, the ink cartridge is detachable and exchangeable from the printing apparatus 300.

A light-reflecting surface or optical prism for detecting the remaining amount of ink is attached to the bottom surface of the ink tank 7.

In FIG. 2, the printhead 1 is mounted on a carriage 2 with such posture as to discharge ink downward in FIG. 2. While the carriage 2 is moved along a guide shaft 3, ink droplets are discharged to form an image on a print medium (not shown) such as a print sheet.

The carriage 2 horizontally moves (reciprocally moves) by rotation of a carriage motor 4 via a timing belt 5. The carriage 2 has an engaging claw 6, which is engaged with an ink tank engaging hole 7*a* to fix the ink tank 7 to the carriage 2.

In print operation, when printing of one scanning (raster) by the printhead 1 ends, print operation suspends, and the print medium on a platen 8 is conveyed by a predetermined amount by driving of a feed motor 9. The carriage 2 is then moved along the guide shaft 3 to form an image by one scanning.

A recovery unit 10 which performs recovery operation for keeping a good ink discharge state of the printhead 1 is disposed on the right side of the apparatus main body. The recovery unit 10 has a cap 11 which caps the printhead 1, a wiper 12 which wipes the ink discharge surface of the printhead 1, and a suction pump (not shown) for sucking ink from the ink discharge nozzle of the printhead 1.

The driving force of the feed motor 9 for conveying a print medium is transmitted to an original print medium convey mechanism, and also to an ASF (Auto Sheet Feeder) 13.

At the end of printing for one page of a print medium, e.g., print sheet, the feed motor 9 is driven to discharge the print sheet outside the printing apparatus 300. To print on the next print sheet, the ASF 13 is also driven to feed the next sheet from print sheets stacked on the ASF 13.

An optical sensor 14 which is comprised of an infrared LED (light-emitting element) 15 and phototransistor (light-receiving element) 16 and constitutes a reflection sensor for detecting the remaining amount of ink is arranged on the side of the recovery unit 10. The light-emitting element 15 and light-receiving element 16 are attached side by side along the print sheet convey direction (direction indicated by an arrow F).

The optical sensor 14 is attached to the chassis 17 of the apparatus main body. When the ink cartridge 20 is mounted on the carriage 2 and moves right from a position shown in FIG. 2, the ink cartridge 20 is located at a position (remaining ink amount detection position) on the optical sensor 14. The ink state can be detected by the optical sensor 14 from the bottom surface of the ink tank 7.

An output from the optical sensor 14 is an analog output. The output value may be output as the remaining amount of ink, or an A/D-converted digital value may be output as the remaining amount of ink.

Figure 3:
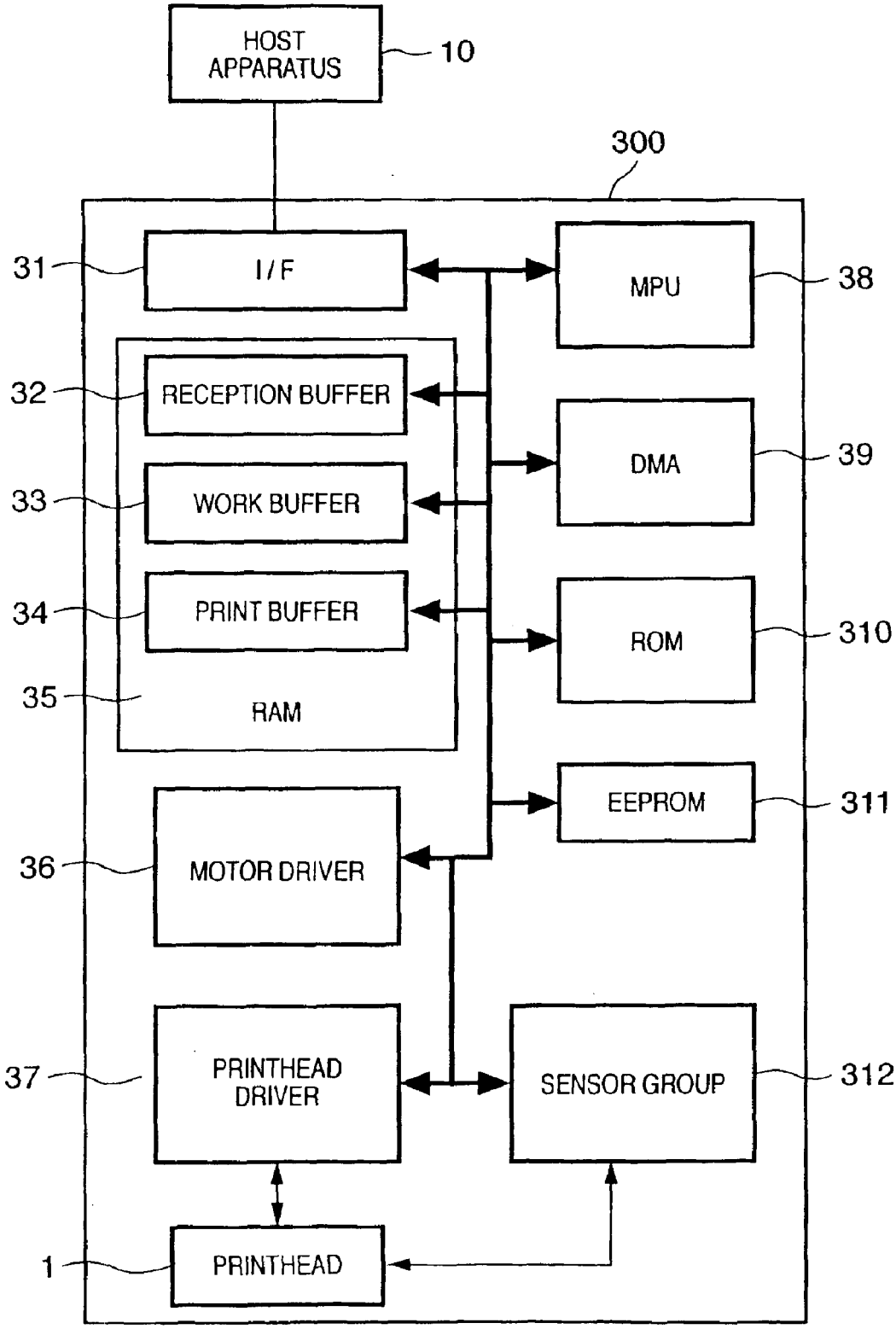
FIG. 3 is a block diagram showing the hardware arrangement of the printing apparatus according to the embodiment of the present invention.

FIG. 3 is a block diagram showing the hardware arrangement of the printing apparatus according to the embodiment of the present invention.

Reference numeral 38 denotes an MPU which controls various building components of the printing apparatus 300; and 31, an I/F which is connected to an external apparatus such as a host apparatus 10 and exchanges various data. As the I/F form, both serial and parallel interfaces are available. An example of the serial interface is a USB interface, and an example of the parallel interface is a Centronics interface.

Reference numeral 35 denotes a RAM. A plurality of dedicated memory areas are ensured in the RAM 35, and especially a reception buffer 32, work buffer 33, and print buffer 34 are ensured in the embodiment. The reception buffer 32 temporarily stores print data (print control information, image data, and the like) received from the host apparatus 10. The work buffer 33 functions as a work area for processing executed by the printing apparatus 300. The print buffer 34 stores print image data actually used for printing.

Reference numeral 36 denotes a motor driver which drives, under the control of the MPU 38, various motors such as a motor for driving the printhead 1 of the printing apparatus 300 and a motor for conveying a print medium; and 37, a printhead driver which drives the printhead 1 under the control of the MPU 38.

Reference numeral 39 denotes a DMA which executes data transfer between a plurality of dedicated memory areas in the RAM 35; and 310, a ROM which stores a program for executing various control operations by the printing apparatus 300 and a program for executing various flow charts to be described later.

Reference numeral 311 denotes an EEPROM which stores data such as various parameters necessary for processing to be executed by the printing apparatus 300.

Reference numeral 312 denotes a sensor group which detects various states of the printing apparatus 300, and includes a temperature sensor for detecting the temperature of the printhead 1 and a medium detection sensor for detecting the presence/absence of a print medium, in addition to the optical sensor 14 and guide detection sensor 28.

The host apparatus 10 has standard building components mounted in a general-purpose computer (e.g., a CPU, RAM, ROM, hard disc, external memory, network interface, display, keyboard, and mouse).

The host apparatus 10 has a command transmission tool for transmitting to the printing apparatus 300 a command for causing the printing apparatus 300 to execute various processes, and a special setting command print transmission tool for transmitting to the printing apparatus 300 a command (disc tray rejection reference setting command) for setting a print reference position in printing an image on a disc medium on the disc tray. The host apparatus 10 can transmit a special setting command to the printing apparatus 300 by using the special setting command print transmission tool.

The special setting command print transmission tool may be realized as a dedicated application which runs on the OS of the host apparatus 10, or a function of the printer driver of the printing apparatus 300.

The disc tray rejection reference setting command is, e.g., information representing whether the print reference position is the top or bottom of the tray. By this information, the rejection amount of image data which is not used for printing an image on a disc medium but is rejected can be calculated out of image data received from the host apparatus 10. That is, information represented by the disc tray rejection reference setting command is reference information (disc tray rejection reference) for calculating a rejection amount.

Special setting command analysis processing executed when the printing apparatus 300 receives a disc tray rejection reference setting command serving as a special setting command from the host apparatus 10 will be explained with reference to FIG. 4.

Figure 4:
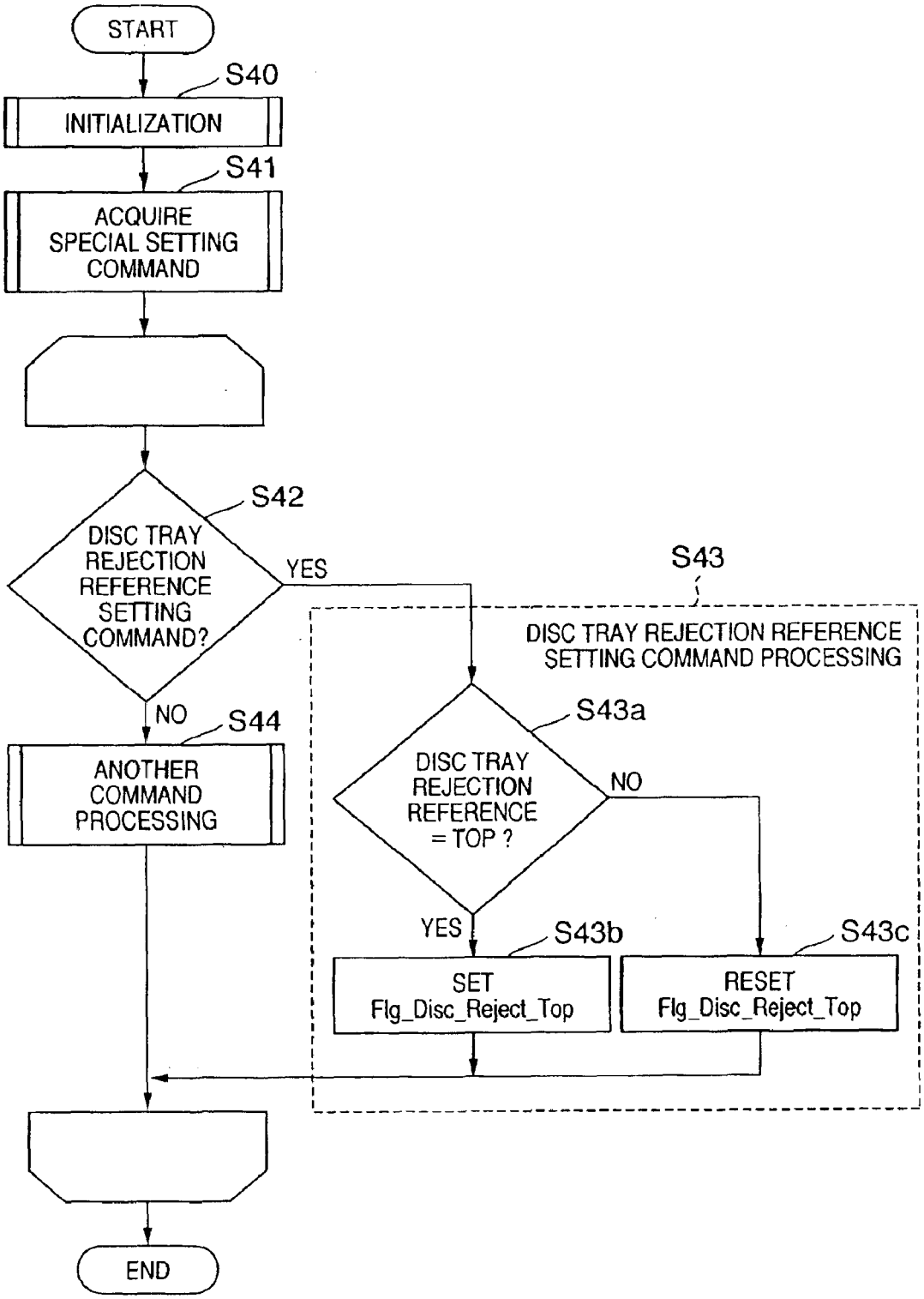
FIG. 4 is a flow chart showing special setting command analysis processing executed by the printing apparatus according to the embodiment of the present invention.

FIG. 4 is a flow chart showing special setting command analysis processing executed by the printing apparatus according to the embodiment of the present invention.

Processing shown in FIG. 4 may be implemented by executing by the MPU 38 a program stored in the internal ROM 310 of the printing apparatus 300, or by dedicated hardware. Various commands, flags, and parameters explained in the flow charts of FIG. 4 and subsequent drawings are properly stored in the EEPROM 311. These commands, flags, and parameters concern control of the printing apparatus 300, and will be generally called print control information.

Initialization processing is executed (step S40). A special setting command is acquired (step S41). After the wait for input of a command, whether the input command is a disc tray rejection reference setting command is determined (step S42). If the input command is not a disc tray rejection reference setting command (NO in step S42), the processing advances to step S44 to execute command processing for the input command. If the input command is a disc tray rejection reference setting command (YES in step S42), the processing advances to step S43 to execute disc tray rejection reference setting command processing.

In disc tray rejection reference setting command processing in step S43, whether the disc tray rejection reference represented by the disc tray rejection reference setting command is the top of the disc tray is determined (step S43*a*).

If the disc tray rejection reference is the top of the disc tray (YES in step S43*a*), the processing advances to step S43*b* to set a disc tray rejection reference top flag (Flg_Disc_Reject_Top). If the disc tray rejection reference is not the top of the disc tray (NO in step S43*a*), i.e., the disc tray rejection reference is the bottom, the disc tray rejection reference top flag (Flg_Disc_Reject_Top) is reset.

The setting of the disc tray rejection reference top flag (Flg_Disc_Reject_Top) is held in, e.g., the EEPROM 311 until a disc tray rejection reference setting command is newly received from the host apparatus 10 or the printing apparatus 300 is reset or powered off.

Command processing executed by the printing apparatus 300 on the basis of image data and a command received from the host apparatus 10 will be explained with reference to FIG. 5.

Figure 5:
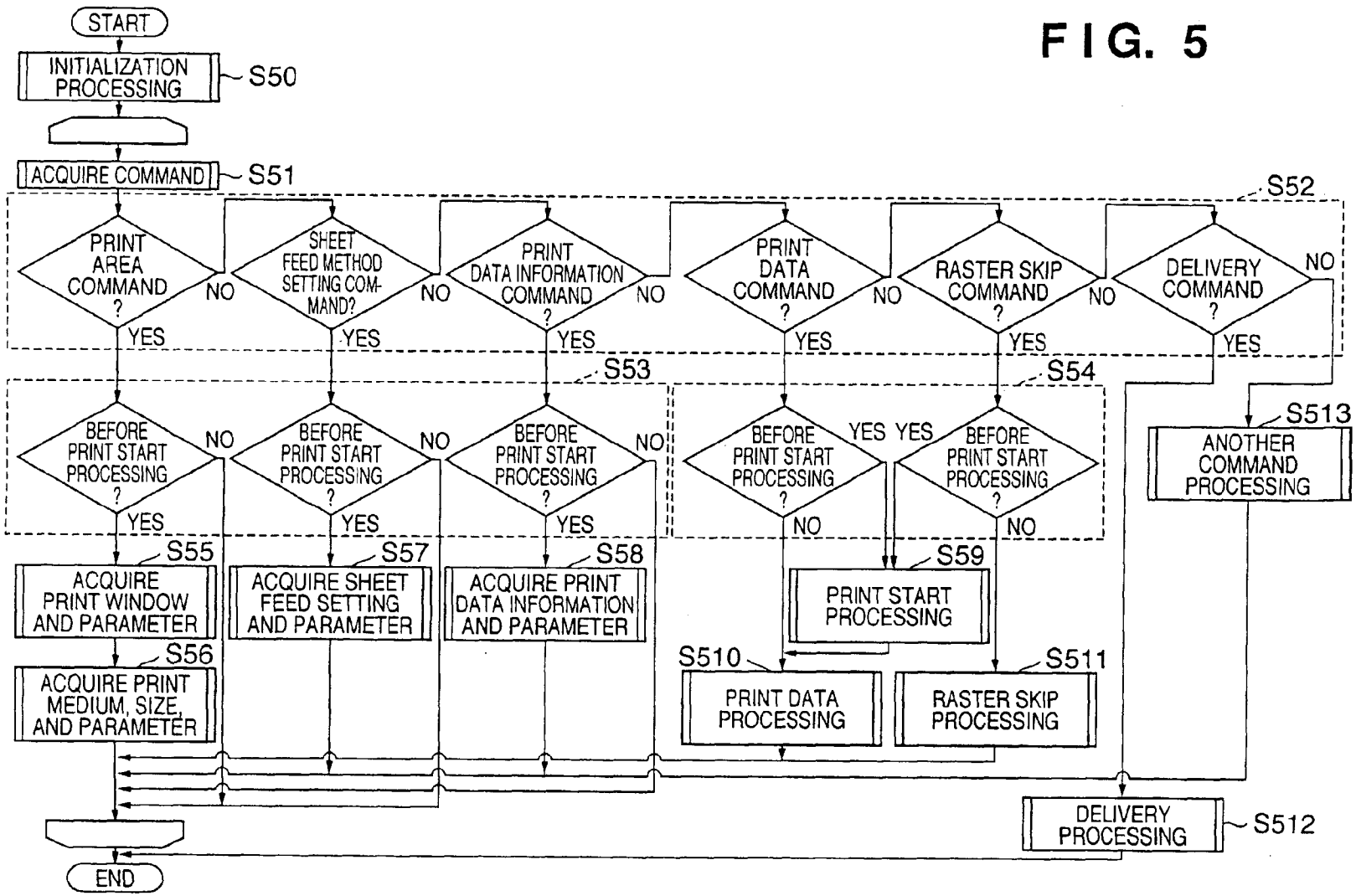
FIG. 5 is a flow chart showing command processing executed by the printing apparatus according to the embodiment of the present invention.

FIG. 5 is a flow chart showing command processing executed by the printing apparatus according to the embodiment of the present invention.

Processing shown in FIG. 5 may be implemented by executing by the MPU 38 a program stored in the internal ROM 310 of the printing apparatus 300, or by dedicated hardware.

Initialization processing is executed (step S50). A command stored in the reception buffer 32 is acquired (step S51). After the wait for input of a command, various processes corresponding to the input command are executed (step S52).

In step S52, whether the command received from the host apparatus 10 is a print area command, sheet feed method setting command, print data information command, print data command, raster skip command, delivery command, or another command is determined.

If the command is a print area command, sheet feed method setting command, or print data information command in step S52, whether the acquisition timing is before print start processing is determined (step S53). If the acquisition timing is after print start processing (NO in step S53), the processing ends. If the acquisition timing is before print start processing (YES in step S53), command processing corresponding to each command is executed.

If the command is a print data command or raster skip command in step S52, whether the acquisition timing is before print start processing is determined (step S54). If the acquisition timing is before print start processing (YES in step S54), print start processing is executed (step S59). If the acquisition timing is after print start processing (NO in step S54), command processing corresponding to each command is executed.

Details of print start processing will be described later.

After command processing corresponding to each command, the processing returns to step S51 again. The processing escapes from a loop of command acquisition, determination, and processing after delivery processing (step S512) is performed when a delivery command is acquired.

For a command other than the above-mentioned commands, command processing corresponding to the command is properly executed (step S53), and then the processing ends. Details of this processing are irrelevant to the present invention, and a description thereof will be omitted.

Command processing by each command will be explained.

If the command is a print area command, acquisition of a print area parameter (step S55) and acquisition of the size parameter of a print medium (various types of print media are available, in this case, only the tray of a disc medium will be explained, and the print medium=the disc tray hereinafter) (step S56) are executed as print area command processing.

The relationship between the printable region of the disc tray and a print area designation region set by the host apparatus 10 according to the embodiment will be explained with reference to FIG. 6.

Figure 6:
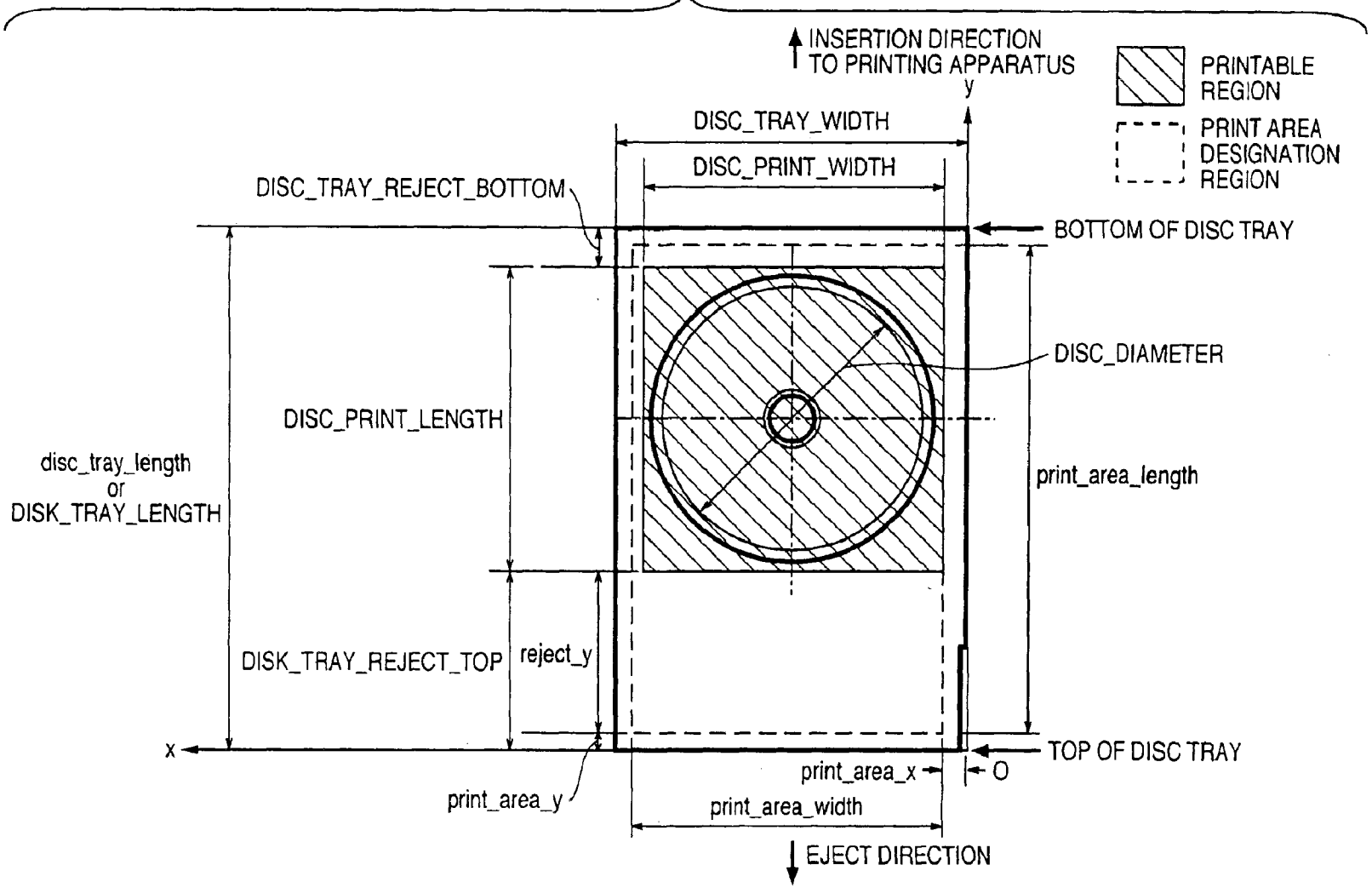
FIG. 6 is a view for explaining the relationship between the printable region of the disc tray and a print area designation region set by the host apparatus according to the embodiment of the present invention.

FIG. 6 is a view for explaining the relationship between the printable region of the disc tray and a print area designation region set by the host apparatus according to the embodiment of the present invention.

Parameters for defining the print area designation region and the size of a print medium are set on the basis of an x-y coordinate system in which the top of the disc tray in FIG. 6 is defined as the x-axis, the rightmost end of the disc tray when its bottom is located up with respect to the top of the disc tray is defined as the y-axis, and the lower right corner of the disc tray is defined as the origin.

The print area parameter which defines a print area designation region is given by the coordinates of the lower right corner of a broken rectangle shown in FIG. 6. In this case, the parameter name of the x-coordinate is print_area_x, and the parameter name of the y-coordinate is print_area_y. The parameter name of the width of the print area designation region is print_area_width, and the parameter name of the length of the print area designation region is print_area_length. Numerical values for each resolution of the printing apparatus 300 are substituted into the parameters, and temporarily stored in the EEPROM 311.

As the print medium size parameter which defines the size of a print medium (=disc tray), the parameter name of the origin O and the width of the disc tray is DISC_TRAY_WIDTH, and the parameter name of the length of the disc tray is DISC_TRAY_LENGTH. Numerical values for each resolution of the printing apparatus 300 are substituted into the parameters, and temporarily stored in the EEPROM 311.

In FIG. 6, DISC_TRAY_REJECT_TOP represents the top margin of the disc tray, and DISC_TRAY_REJECT_BOTTOM represents the bottom margin of the disc tray. DISC_PRINT_LENGTH represents the length of an actual disc printable region, DISC_PRINT_WIDTH represents the width of the actual disc printable region, and DISC_DIAMETER represents the diameter of the actual disc printable region. Further, reject_y represents the rejection amount in the y direction.

Referring back to FIG. 5, if the command is a sheet feed method setting command, a sheet feed setting parameter is acquired as sheet feed method setting command processing (step S57). As the sheet feed setting parameter (sheet feed method, print medium type, print direction, the number of copies, or the like), a disc tray print flag is set when the sheet feed setting of the disc tray is designated.

If the command is a print data information command, a print data information parameter is acquired as print data information command processing (step S58).

If the command is a print data command, print data processing is executed (step S510) after print start processing (step S59). The print data command contains a command length and image data corresponding to the command length after a command. In print data processing in step S510, image data is stored in the work buffer 33. After printable image data is stored, the data is mapped in the print buffer 34 and printed.

If the command is a raster skip command, raster skip processing is executed (step S511) after print start processing (step S59). In raster skip processing in step S511, processing of conveying a print medium by an amount corresponding to the parameter (raster skip amount raster_skip) of the raster count at each resolution is performed.

If disc tray rejection processing to be described later is performed in steps S510 and S511, rejection processing is executed.

Details of print start processing in step S59 will be explained with reference to FIG. 7.

Figure 7:
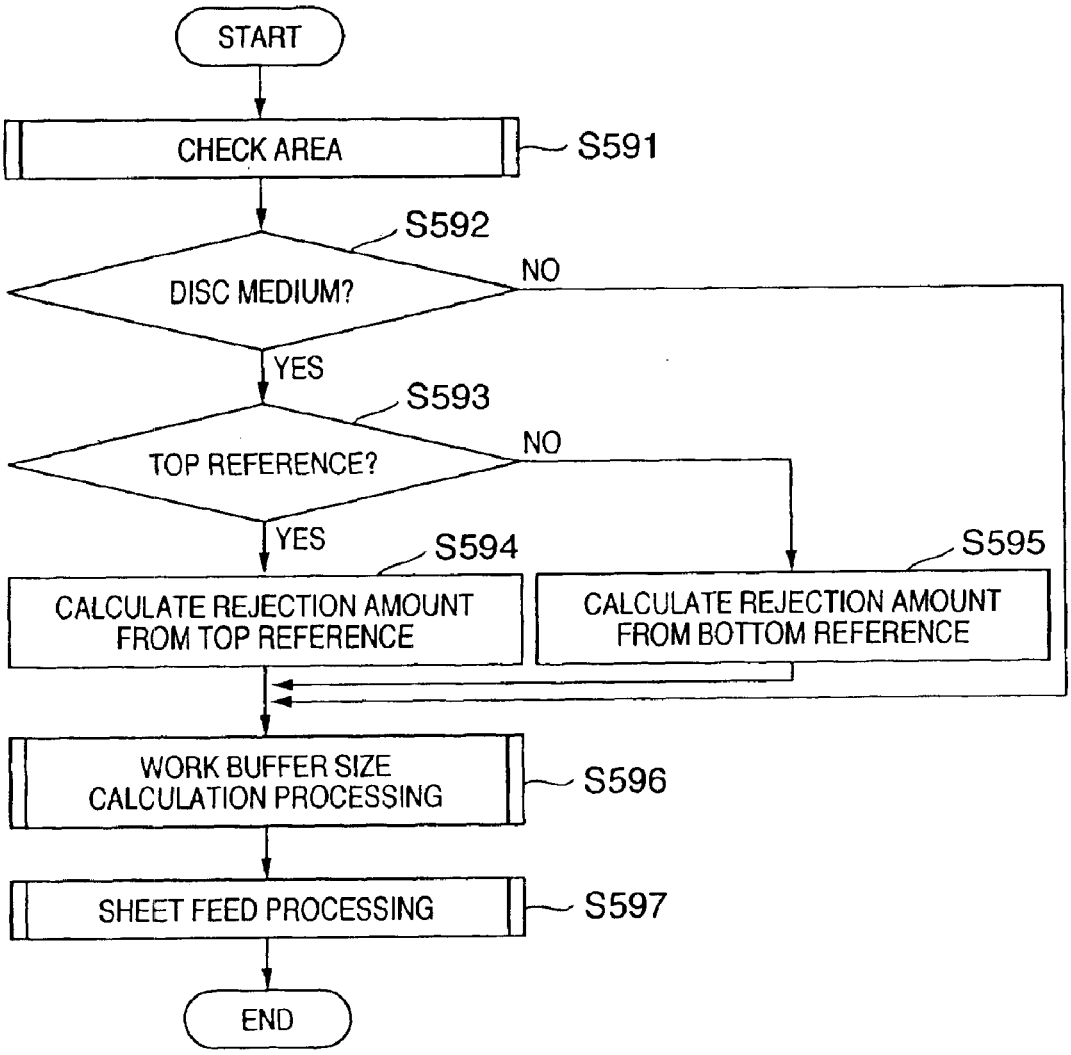
FIG. 7 is a flow chart showing details of print start processing according to the embodiment of the present invention.
Figure 8:
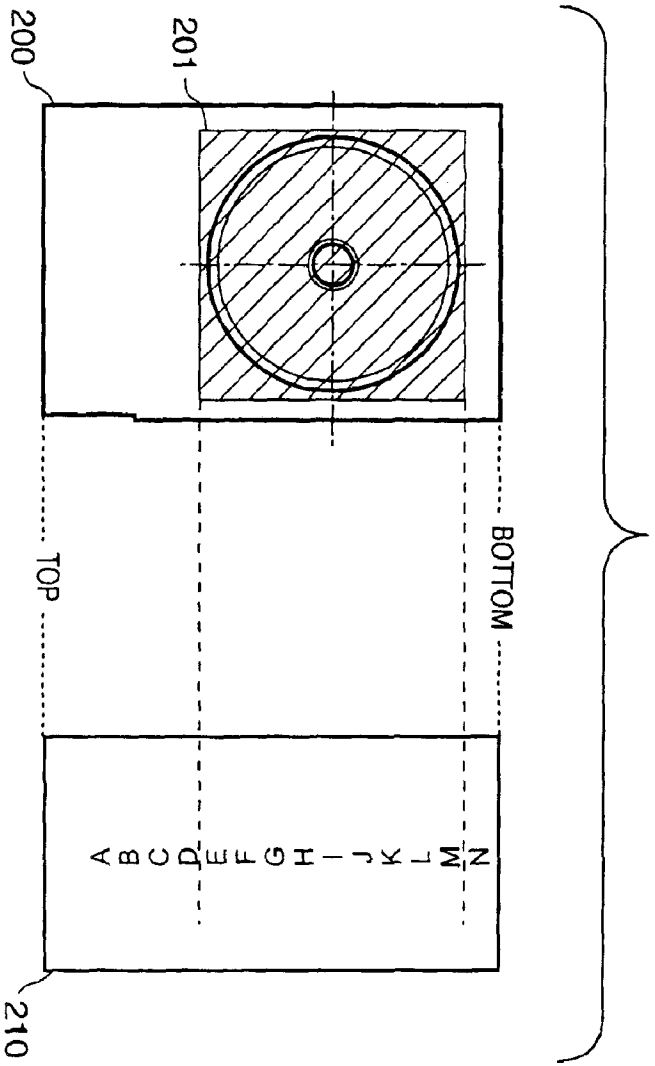
FIG. 8 is a view for explaining the relationship between the physical print area and the logical print area.
Figure 9:
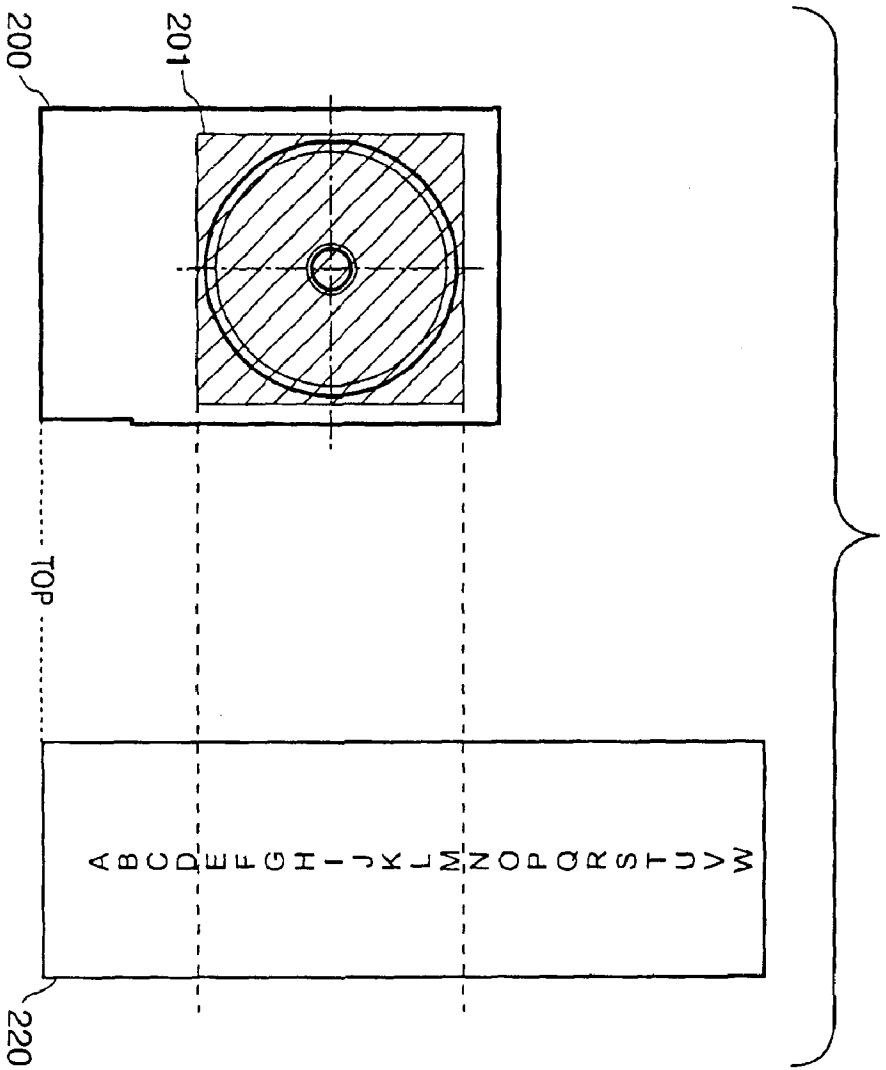
FIG. 9 is a view for explaining the relationship between the physical print area and the logical print area.
Figure 10:
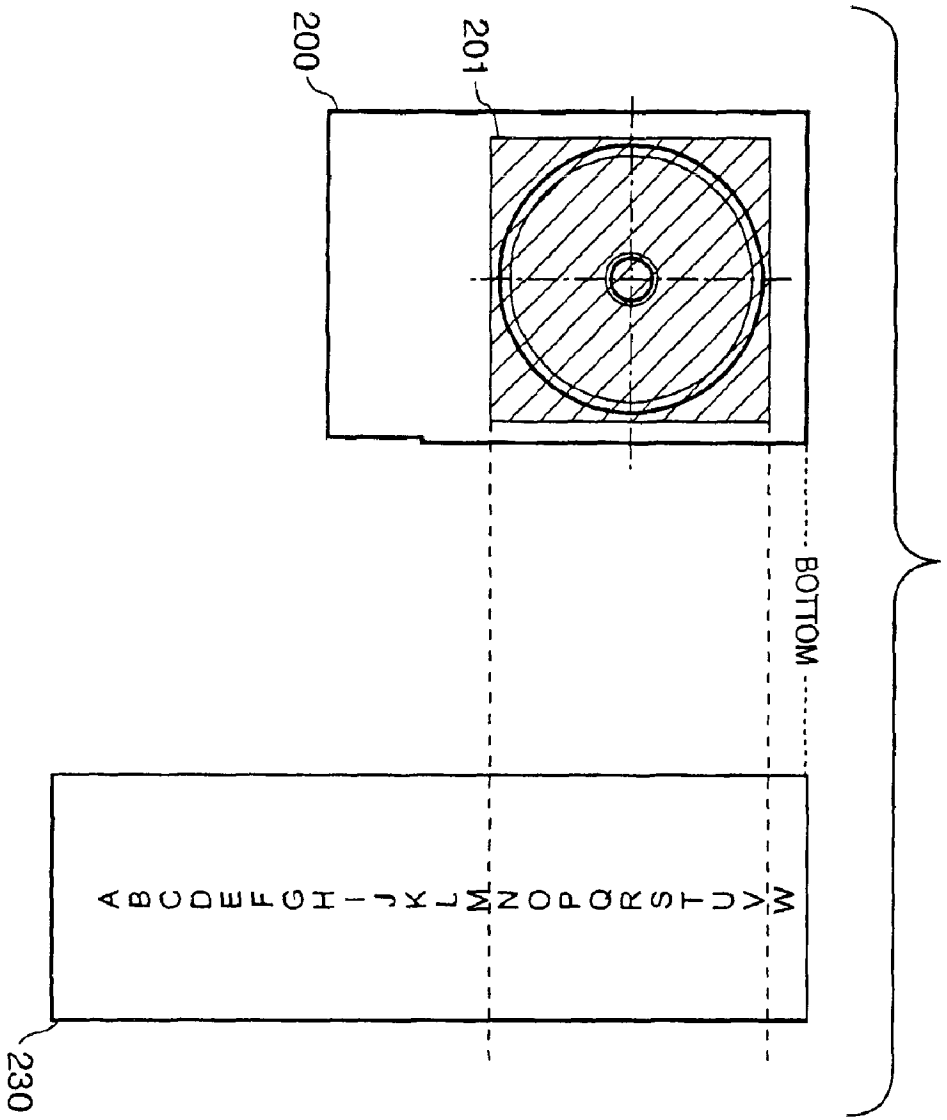
FIG. 10 is a view for explaining the relationship between the physical print area and the logical print area.

FIG. 7 is a flow chart showing details of print start processing according to the embodiment of the present invention.

In print start processing, a check on matching between a print medium and the print area, calculation of the size of the work buffer 33 per raster where image data is to be stored, and sheet feed processing are performed on the basis of the print area parameter, print medium size parameter, sheet feed setting parameter, and print data information parameter.

FIG. 7 is a flow chart showing details of print start processing executed by the printing apparatus according to the embodiment of the present invention.

Matching of the print area is checked from the print area parameter, print medium size parameter, and sheet feed setting parameter (step S591). Whether the print medium is a disc medium is determined from the sheet feed setting parameter (step S592). If the print medium is not a disc medium (NO in step S592), the processing advances to step S596. If the print medium is a disc medium (YES in step S592), the processing advances to step S593.

Which of "the top of the disc tray" and "the bottom of the disc tray" is set as a reference position for calculating the rejection amount at the top margin between the print area designation region given by the print area parameter and the printable region of the disc tray is determined (step S593). The reference position is determined from the Flg_Disc_Reject_Top state set in step S433 of FIG. 4.

If the reference position is the top reference (YES in step S593), the processing advances to step S594 to calculate the rejection amount reject_y from the difference (rejection amount from the top reference) between the disc tray top margin DISC_TRAY_REJECT_TOP and the print area parameter print_area_y:

$$reject_y = DISC_TRAY_REJECT_TOP - print_area_y$$

If the reference position is the bottom reference (NO in step S593), the processing advances to step S595 to calculate the rejection amount reject_y from the difference (rejection amount from the bottom reference) between the print medium size parameter disc_tray_length and the sum of the disc printable region length DISC_PRINT_LENGTH and disc tray bottom margin DISC_TRAY_REJECT_BOTTOM:

$$reject_y = disc_tray_length - (DISC_PRINT_LENGTH + DISC_TRAY_REJECT_BOTTOM)$$

After that, calculation processing of a work buffer size for storing image data necessary for printing is executed on the basis of the processing result of step S594 or S595 (step S596). Sheet feed processing is then executed (step S597).

Referring back to FIG. 5, in print data processing in step S510, for reject_y>0, the rejection amount reject_y is subtracted every time rejection processing for image data of one raster out of image data stored in the work buffer 33 is performed. Rejection processing continues till reject_y=0. Upon the completion of rejection processing, image data stored in the work buffer 33 is mapped in the print buffer 34 and printed.

In raster skip processing in step S511, for reject_y>0 and the raster skip amount raster_skip>reject_y, $$raster_skip = raster_skip - reject_y$$

For reject_y>0 and the raster skip amount raster_skip≦reject_y, $$raster_skip = 0$$

and $$reject_y = reject_y - raster_skip$$

These parameters are used as parameters of rejection processing in the next print data processing (step S510) or raster skip processing (step S511).

In this manner, rejection processing continues till the rejection amount reject_y=0.

As described above, according to the embodiment, the host apparatus 10 transmits to the printing apparatus 300 image data to be printed and a command (disc tray rejection reference setting command) for setting the print reference position in printing the image data on a disc medium on the disc tray.

The printing apparatus 300 determines which of the top reference of the disc tray or the bottom reference of the disc tray is used for image data rejection processing in printing on the disc tray. The printing apparatus 300 can execute rejection processing based on the determined reference. As a result, proper rejection processing can be executed at both the settings of the disc tray top reference and disc tray bottom reference.

The embodiment has been described in detail. The present invention may be applied to a system including a plurality of devices or an apparatus formed from a single device.

The present invention is also achieved by supplying a software program (in the above embodiment, programs corresponding to flow charts shown in the accompanying drawings) for realizing the functions of the above-described embodiment to a system or apparatus directly or from a remote place, and reading out and executing the supplied program codes by the computer of the system or apparatus.

The present invention is therefore realized by program codes installed into the computer in order to realize functional processing of the present invention by the computer. That is, the present invention includes a computer program for realizing functional processing of the present invention.

In this case, the present invention can take any program form such as an object code, a program executed by an interpreter, or script data supplied to an OS as long as a program function is attained.

A recording medium for supplying the program includes a floppy® disc, hard disc, optical disc, magnetooptical disc, MO, CD-ROM, CD-R, CD-RW, magnetic tape, nonvolatile memory card, ROM, and DVD (DVD-ROM and DVD-R).

As another program supply method, the program can be supplied by connecting a client computer to an Internet homepage via the browser of the client computer, and downloading the computer program of the present invention or a compressed file containing an automatic installing function from the homepage to a recording medium such as a hard disc. The program can also be supplied by grouping program codes which constitute the program of the present invention into a plurality of files, and downloading the files from different homepages. That is, the present invention also includes a WWW server which allows a plurality of users to download the program files for realizing functional processing of the present invention by a computer.

The program of the present invention can be encrypted, stored in a storage medium such as a CD-ROM, and distributed to the user. A user who satisfies predetermined conditions is caused to download decryption key information from a homepage via the Internet. The user executes the encrypted program by using the key information, and installs the program in the computer.

The functions of the above-described embodiment are realized when the computer executes a readout program. Also, the functions of the above-described embodiment are realized when an OS or the like running on a computer performs part or all of actual processing on the basis of the instructions of the program codes.

The functions of the above-described embodiment are also realized when a program read out from a storage medium is written in the memory of a function expansion board inserted into a computer or the memory of a function expansion unit connected to the computer, and the CPU of the function expansion board or function expansion unit performs part or all of actual processing on the basis of the instructions of the program codes.

As has been described above, the present invention can provide a printing apparatus capable of appropriately executing print processes corresponding to various print conditions on a print medium set on a tray, an information processing apparatus, a control method therefor, and a program.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus which conveys a tray supporting a print medium into the printing apparatus and prints on the print medium by using a top or bottom of the tray as a print reference position, comprising:

a reception unit that receives print control information containing information on the print reference position, a print area designation region, and a print medium, and image data corresponding to the print area designation region;

a determination unit that determines the print reference position concerning printing of the image data on the basis of the print control information;

a calculation unit that calculates a rejection amount of image data which is not used for printing but is rejected out of the image data, on the basis of a determination result of said determination unit, the print area designation region, and a printable region of the print medium;

a rejection unit that rejects, from the image data, image data corresponding to the rejection amount calculated by said calculation unit; and a control unit that controls printing of the image data by using image data which is not rejected by said rejection unit.

2. The apparatus according to claim 1, wherein the information on the print reference position that is contained in the print control information includes information representing whether the print reference position is the top or bottom of the tray.

3. The apparatus according to claim 1, wherein said calculation unit calculates, as the rejection amount, a margin region between a top of the print area designation region and a top of the printable region of the print medium on the basis of the print reference position determined by said determination unit.

4. The apparatus according to claim 1, wherein the print medium includes a disc medium.

5. The apparatus according to claim 1, wherein said reception unit receives the print control information and the image data from a host apparatus connected to the printing apparatus.

6. A method of controlling a printing apparatus which conveys a tray supporting a print medium into the printing apparatus and prints on the print medium by using a top or bottom of the tray as a print reference position, comprising:

receiving print control information containing information on the print reference position, a print area designation region, and a print medium, and image data corresponding to the print area designation region;

determining the print reference position concerning printing of the image data on the basis of the print control information;

calculating a rejection amount of image data which is not used for printing but is rejected out of the image data, on the basis of the determination result, the print area designation region, and a printable region of the print medium;

rejecting, from the image data, image data corresponding to the calculated rejection amount; and controlling printing of the image data by using image data which is not rejected.

7. A program which realizes control of a printing apparatus that conveys a tray supporting a print medium into the printing apparatus and prints on the print medium by using a top or bottom of the tray as a print reference position, comprising:

a program code that receives print control information containing information on the print reference position, a print area designation region, and a print medium, and image data corresponding to the print area designation region;

a program code that determines the print reference position concerning printing of the image data on the basis of the print control information;

a program code that calculates a rejection amount of image data which is not used for printing but is rejected out of the image data, on the basis of a determination result, the print area designation region, and a printable region of the print medium;

a program code that rejects, from the image data, image data corresponding to the calculated rejection amount; and a program code that controls printing of the image data by using image data which is not rejected.

* * * * *